US006096119A

United States Patent [19]

Ho et al.

[11] Patent Number: 6,096,119

[45] Date of Patent: Aug. 1, 2000

[54] APPARATUS FOR USING FERRITE SPACERS TO SUPPRESS ARC NOISE IN ELECTROSTATIC PRECIPITATORS

[75] Inventors: Chi-Pai Ho; Ronald D. Voigts, both of Cary; Charles A. Haynes; James S. Blair, both of Sanford, all of N.C.

[73] Assignee: Trion, Inc., Sanford, N.C.

[21] Appl. No.: 09/114,906

[22] Filed: Jul. 14, 1998

[51] Int. Cl.[7] ..... B03C 3/08

[52] U.S. Cl. ..... 96/79; 96/21; 96/87

[58] Field of Search ..... 96/20, 79, 86–88, 96/78, 21

[56] References Cited

U.S. PATENT DOCUMENTS

| | | | |
|---|---|---|---|
| 2,470,356 | 5/1949 | MacKenzie | 96/87 |
| 2,521,605 | 9/1950 | Richardson | 96/87 |
| 3,006,066 | 10/1961 | Grossen et al. | 96/87 X |
| 3,017,952 | 1/1962 | Westlin | 96/86 |
| 3,017,953 | 1/1962 | Rivers | 96/86 |
| 3,114,616 | 12/1963 | Palmore | 96/86 |
| 3,581,470 | 6/1971 | Aitkenhead et al. | 96/79 |
| 3,648,437 | 3/1972 | Bridges | 96/20 |
| 3,985,525 | 10/1976 | Tomaides | 96/79 |
| 4,166,729 | 9/1979 | Thompson et al. | 96/86 X |
| 5,137,552 | 8/1992 | Sasaki | 96/86 X |
| 5,433,772 | 7/1995 | Sikora | 96/88 X |

FOREIGN PATENT DOCUMENTS 2582975 11/1996 Japan .

OTHER PUBLICATIONS

International Search Report dated Oct. 18, 1999 for PCT/US99/14131.

*Primary Examiner*—Richard L. Chiesa

*Attorney, Agent, or Firm*—Burns, Doane, Swecker & Mathis LLP

[57] ABSTRACT

In a two-stage, electrostatic precipitator for extracting airborne particles, charged plates are electrically connected to each other and physically separated from each other by ferrite spacers so that an impedance of the spacers limits an amount of arc discharge current that will flow when an arc discharge occurs from one of the charged plates. Ferrite spacers can also be provided to electrically connect and physically separate grounded plates in the precipitator. In addition, aluminum spacers can be provided to adjust the impedance of the series of spacers through which an arc discharge current flows, so that the current is a minimum necessary amount for an arc detection circuit to detect.

21 Claims, 8 Drawing Sheets

APPARATUS FOR USING FERRITE SPACERS TO SUPPRESS ARC NOISE IN ELECTROSTATIC PRECIPITATORS

BACKGROUND OF THE INVENTION

1. Field of the Invention

The present invention is directed generally to removing smoke, dust and fumes from the air using an electrostatic precipitator (ESP) having high voltage plates. More specifically, the invention is directed to limiting arc discharge energy and suppressing the arc noise of electric arcs that can occur from the ESP's high voltage plates.

2. Description of Related Art

A conventional two-stage ESP operates by ionizing and precipitating aerosols from the air. Air laden with particles first passes through an ionization section of the ESP, where the particles receive unipolar charges and become charged particles. The air and the charged particles then pass through a precipitation section of the ESP, which includes an alternating series of charged and grounded plates, also known as precipitating plates. The plates generate high electric field gradients, and electrical forces drive the charged particles toward those plates that have a polarity opposite to that of the charge on the particles. This allows the charged particles to be precipitated and removed from the air with a high collection efficiency. The precipitating plates toward which the charged particles move are also known as collection plates.

There are primarily two types of ionizers. In the first type, fine tungsten wire's seven to 10 mils in diameter are commonly used as high voltage, ionizing electrodes. In the second type, sharp pointed elements such as spiked stainless steel blades, or sharp needles, are used as high voltage, ionizing electrodes. When supplied with a sufficient voltage, an ionize can generate unipolar ions in a concentration that ranges from 10 million to 100 million ions per cubic centimeter of air. Some of these ions then impart charge to any particles passing through the ionizer. With such a high ion concentration, airborne particles passing through the ionization section are usually charged up to a saturation level within a fraction of a second. The saturation level of a particle generally depends on the surface area of the particle. This is because the ions charge up the particle by adhering to it, and the number of ions that can adhere to the particle is generally limited by the available surface area of the particle.

The collection section of the conventional two-stage electrostatic precipitator is typically composed of a plurality of parallel plates. Some of the plates are electrically connected to a high voltage and others of the plates are grounded, and the plates are positioned in an alternating sequence so that for each plate in the sequence, the plate or plates adjacent to it have the opposite polarity. For example, a high voltage plate in the middle of the sequence will have grounded plates adjacent to it. Metal tie rods and aluminum spacers are usually used to physically secure the high voltage plates and the grounded plates, and also to appropriately connect each plate to either a high voltage source or to a ground. Clearance holes are provided in the high voltage plates to prevent the grounded tie rods and aluminum spacers from touching the high voltage plates, and clearance holes are provided in the grounded plates to prevent tie rods and aluminum spacers that are electrically connected to the high voltage source from contacting the grounded plates. In this manner, all high voltage plates are connected to the same high voltage level, and all grounded plates are grounded. The electric potential between the high voltage level and ground is typically thousands of volts, and can be, for example, between about 3 kV and about 6 kV.

A properly designed ESP does not arc during normal operating conditions. However, high voltage arcing can occur between the high voltage, or charged, plates and the grounded plates when the spacing between the plates is effectively reduced. For example, the airspace between the plates can be narrowed by the accumulation of deposited fibers, dust particles, lint, or other types of contaminants in the airspace between the plates. When the spacing between plates becomes less than the electrical breakdown distance of air, a high voltage between the plates can create a path or arc through the air over which current flows from the charged plate to the grounded plate. This arc discharge current creates a 'firecracker-like' noise.

Arcing at any particular location on the plates can be continuous until the precipitator is cleaned and the cause of arcing removed, e.g., contaminants are removed so that the effective spacing between the plates is greater than the electrical breakdown distance of the air. The loud noise that an arc generates can be unpleasant and sometimes intolerable to a user. ESP designs that reduce the arc noise are thus highly desirable in various applications such as use in residences, restaurants, meeting rooms, hospitals, etc.

U.S. Pat. No. 4,166,729 to Thompson, et al. discloses precipitating plates made of a rigid, non-conducting material that is coated with a layer of low conductance material, to suppress arc noise. Because voltage potential cannot be effectively transferred through materials having a low conductivity, and since the arc discharge current flows from a voltage source through the low conductance material before reaching an air gap traversed by the arc, any voltage that is dropped across the low conductance material is unavailable at the air gap. This voltage drop reduces an amount of energy traversing the air gap during an arc discharge, and thereby reduces the corresponding arc noise. Thus, an arc discharge at any particular point in the precipitator is isolated from the voltage source by an impedance, and this suppresses a noise level of the arc discharge. In particular, a spark discharge in an ESP can be treated as a capacitor discharge and the total plate area comprises the capacitor. Since a high voltage discharge happens in milliseconds, if the RC time constant of discharge is sufficiently long, for example, greater than a tenth of a second, the high voltage spark or arc discharge over an air gap between two plates can be suppressed or eliminated. The RC time constant equals the resistance (in Ohms) of the plates multiplied by the capacitance (in Farads) of the plates.

One serious disadvantage of the above approach is the high cost of making such coated resistive plates. Precipitating plates which are insulated by a highly resistive material that is coated with an outer layer of low conductivity material can be relatively labor intensive and expensive to manufacture. In contrast, all-aluminum precipitating plates are die-stamped from a coil of aluminum in an operation that is typically carried out in continuous, repetitive cycles that allow large quantities of plates to be manufactured very cost effectively. However, all-aluminum precipitating plates do not suppress arc noise.

OBJECTS AND SUMMARY

Embodiments of the invention solve the foregoing problems by providing an ESP that effectively suppresses arcing, has good particle collection efficiency, and is cost effective.

In accordance with an embodiment of the invention, ferrite spacers are used to conduct high voltage to the collecting plates. In situations where arcing occurs between the charged collecting plates and the grounded plates, the impedance of the ferrite spacers limits the energy discharged through the arc and suppresses the arc noise. ESP machines that incorporate the invention can thus operate much more quietly and are less annoying than conventional ESP machines that use aluminum spacers to physically secure the precipitating plates and to electrically connect the precipitating plates. Furthermore, the ferrite spacers suppress the arc noise without causing a loss in the collection efficiency of the ESP. In an embodiment of the invention, the charged and grounded precipitator plates of an ESP are made of metal.

In another embodiment of the invention, ferrite spacers are used together with aluminum spacers to electrically connect precipitation plates in an ESP that has a power supply equipped with arc-detection circuitry. The ESP can incorporate, for example, the apparatus and method for detecting arcs and controlling a supply of electrical power disclosed in copending application Ser. No. 09/017,659, filed Feb. 3, 1998. Copending application Ser. No. 09/017,659 is hereby incorporated herein by reference. The aluminum spacers adjust the serial impedance created by the ferrite spacers, thereby suppressing the arc discharge noise to a satisfactory level while ensuring that the power supply can detect the arc discharge. Various combinations of ferrite and aluminum spacers for both charged and grounded plates can be used to achieve a desired impedance. The spacers can also physically support the precipitation plates.

The purpose in ensuring that the power supply can detect arc discharges is to allow that power supply to temporarily shut down its power output for a predetermined time period (for example, 5 seconds) after detecting an arc discharge, thus limiting the noise disturbance to that of a single arc instead of the continuous 'firecracker-like' noise that a continuous arc discharge causes. After a certain number of arcs (for example, 10) is detected, the power supply can be designed to shut itself down and turn on a maintenance indicator to alert an operator that the ESP requires maintenance. After the power supply is shut down and the maintenance indicator is activated, the ESP system can remain non-operational until maintenance is provided and the power supply is reset.

Additional features and advantages of the invention will become apparent from the following description of the preferred embodiments, taken in conjunction with the accompanying drawings. The accompanying drawings illustrate, by way of example, the principles of the invention. Like elements are designated with like reference numerals.

DETAILED DESCRIPTION OF THE PREFERRED EMBODIMENTS

Figure 1:
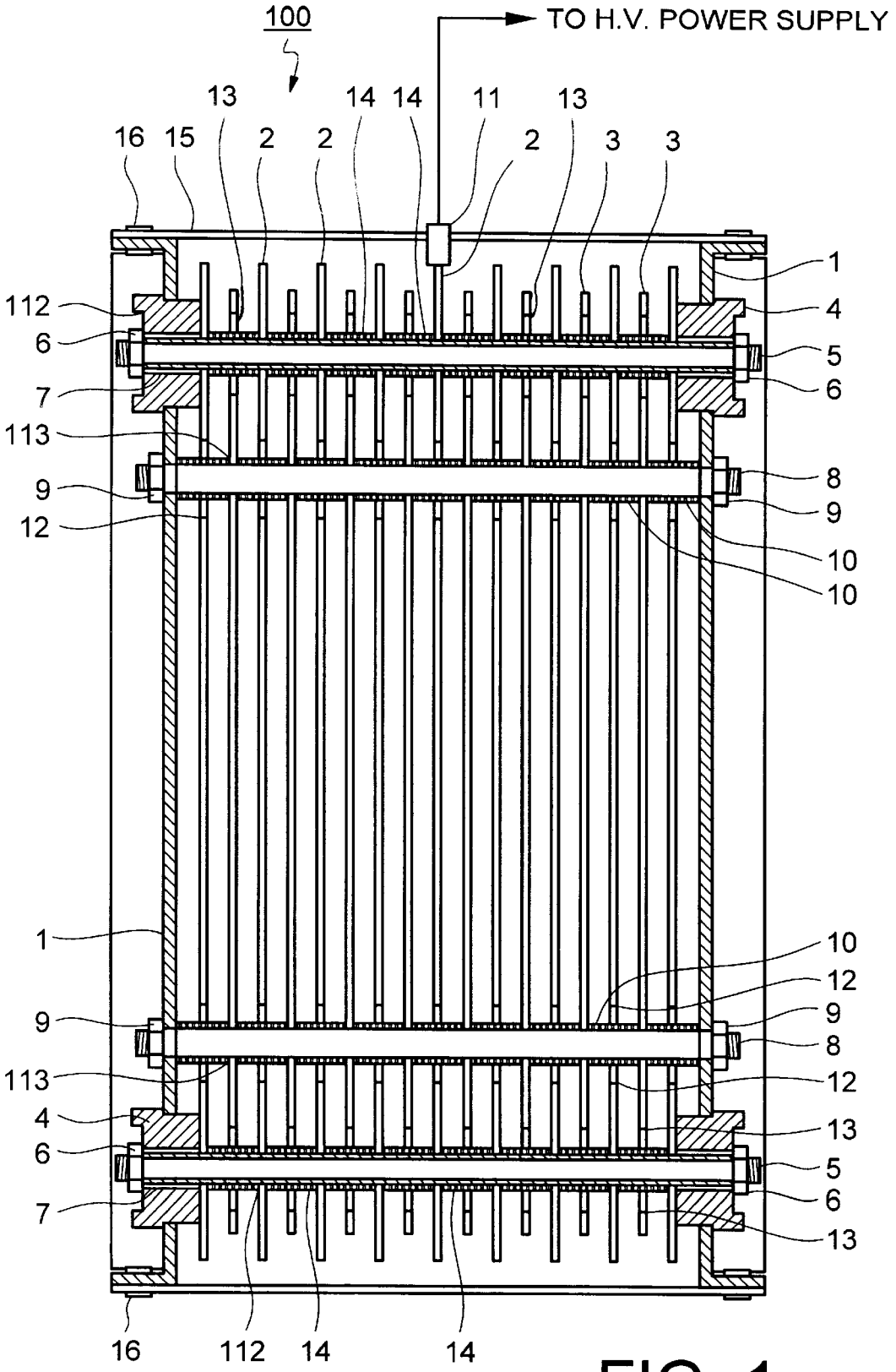
FIG. 1 is a front view of an electrostatic precipitator using ferrite spacers to conduct high voltage to charged plates, in accordance with an embodiment of the invention.

In accordance with a first embodiment of the invention, a two-stage ESP uses ferrite cores as spacers to secure a plurality of charged plates and grounded plates, which together form a collecting stage of the ESP. Ferrites are ceramic materials with the general chemical formula $MOFe_2O_3$, where MO is a divalent metal oxide blended with 48 to 60 mole percent of iron oxide. Different groups of soft ferrites, for example manganese zinc ferrites, nickel zinc ferrites, and manganese ferrites, can be used. Typically ferrite components are used in Electromagnetic Interference (EMI) suppression, as shield beads and broadband chokes where an effective inductive impedance is produced at high frequencies. This invention utilizes such an inductive impedance in series, provided by all the ferrite spacers in the path of an arc discharge, to create a filter that limits the discharge current and reduces noise caused by the arc discharge. Each ferrite spacer can be configured to have, for example, a resistance of about 1,000,000 Ohms and an inductance of about $1\times10^{-6}$ Henries. In exemplary embodiments of the invention, for example, the resistance of each ferrite spacer can be as small as several hundred Ohms or as large as several million Ohms, and the inductance can range from about $1\times10^{-6}$ Henries to about $1\times10^{-3}$ Henries. The invention is not limited to these ranges, however, and other appropriate values of resistance and inductance can be used in accordance with specific design, performance and environmental considerations.

In order to force the high voltage through ferrite spacers, metal tie rods that are commonly used in securing spacers and plates together in an ordinary ESP, are insulated in this embodiment. Other non-conducting tie rods, such as plastic tie rods, can be used in addition to, or instead of, insulated metal tie rods. High voltage contact to the power supply is typically made at the top edge of a first charged plate located in the middle section of the precipitator. Where this is the case, the voltage must go through the ferrite spacers separating the first charged plate from adjacent charged plates on both sides of first charged plate, to reach the adjacent charged plates. The voltage must then go through another set of ferrite spacers to reach the next adjacent plates, and so forth down the line until the voltage reaches the last charged plates on both ends of the precipitator. In this manner, all charged plates are connected together by ferrite spacers. If and when there is a high voltage arc at any particular location from one of the plates, for example between two adjacent plates, energy from the power supply or energy stored in the capacitance of the other charged plates must go through a series of ferrite spacers to reach the point of discharge. Thus the impedance of the ferrite spacers in series can significantly suppress the arc discharge and attendant arc discharge noise. In particular, the ferrite spacers have both an inductive impedance and a resistance, which together create a puissant LR (Inductive-Resistive) filter to limit the arc discharge current and reduce arc noise.

In accordance with a second embodiment of the invention, a combination of ferrite and aluminum spacers can be employed to conduct voltage to the charged plates, to use less ferrite and thus lower the serial impedance. The ferrite and aluminum spacers can be evenly alternated one with one another, or a ferrite spacer can be provided for every two aluminum spacers, or a ferrite spacer for every three aluminum spacers, and so forth. The aluminum spacers can thus be used to adjust and lower the serial impedance. Although lowering the serial impedance increases the arc noise level, the serial impedance is lowered so that the arc discharge current will be sufficiently large to be detected by a power supply for an output delay or power shut down. It thus is an optimization process to select a combination of ferrite and aluminum spacers that will provide a serial impedance that reduces the arc discharge current (and thereby the arc noise level) to a value that is just large enough for a power supply equipped with anti-arc circuitry to detect. By the same principle, the same effect can be obtained by connecting the grounded plates to ground using a combination of ferrite and aluminum spacers.

In accordance with an embodiment of the invention and as shown in FIG. 1, ferrite spacers 14 support, and transfer high voltage to, charged plates 2. The ferrite spacers 14 pass through holes 13 in grounded plates 3, without touching the grounded plates 3. Insulators 4 are used to isolate the high voltage elements from the grounded elements. The insulators 4 can be made of, for example, a ceramic material, or any other material that has suitable insulating properties. Assembly of a precipitator usually starts from one endplate 1 with an insulator 4, high voltage tie rods 5 and ground tie rods 8 secured to the endplate 1 with nuts 6 and 9. With the tie rods 5, 8 facing upward, a high voltage plate 2 is dropped into the assembly so that the tie rods 5, 8 pass through corresponding holes 112, 12 in the high voltage plate 2. Ferrite spacers 14 are then dropped over the high voltage tie rods 5, and aluminum spacers 10 are dropped over the ground tie rods 8. The aluminum spacers 10 pass through holes 12 in the high voltage plates 2, without touching the high voltage plates 2. Next, a grounded plate 3 is dropped into the assembly so that the tie rods 5, 8 pass through corresponding holes 13, 113 in the grounded plate 3, to complete a first cycle of the assembly. The distances between the edges of the holes 13 and the tie rods 5, and between the holes 12 and the tie rods 8, are sufficient to prevent arcing under normal operating conditions. The holes 112 and 113 are only slightly larger than outer diameters of the tie rods 5 and 8 and the inside diameter of the spacers 14 and 10, so that the high voltage plates 2 are secured and stacked up by the ferrite spacers 14, and the grounded plates 3 are secured and stacked up by the aluminum spacers 10. This assembly cycle is repeated until the other endplate 1 is secured to the assembly using nuts 6, 9 so that the plates 2, 3 are sandwiched between the two endplates 1. Top and bottom braces 15 are also provided to further secure the endplates 1 using rivets 16.

The high voltage contact 11 shown in FIG. 1 transfers the high voltage from a power supply to one of the charged plates 2 that is located in the middle of the precipitator 100. The high voltage tie rods 5 are insulated with an insulator 7 located between the tie rods 5 and the ferrite spacers 14. The insulator 7 can be, for example, heat shrink tubing. Thus, the voltage provided at the contact 11 can only be transferred to charged plates 2 other than the charged plate 2 connected directly to the contact 11, via intervening charged plates 2 and ferrite spacers 14. This is shown in the electrical schematic diagram of FIG. 2.

Figure 2:
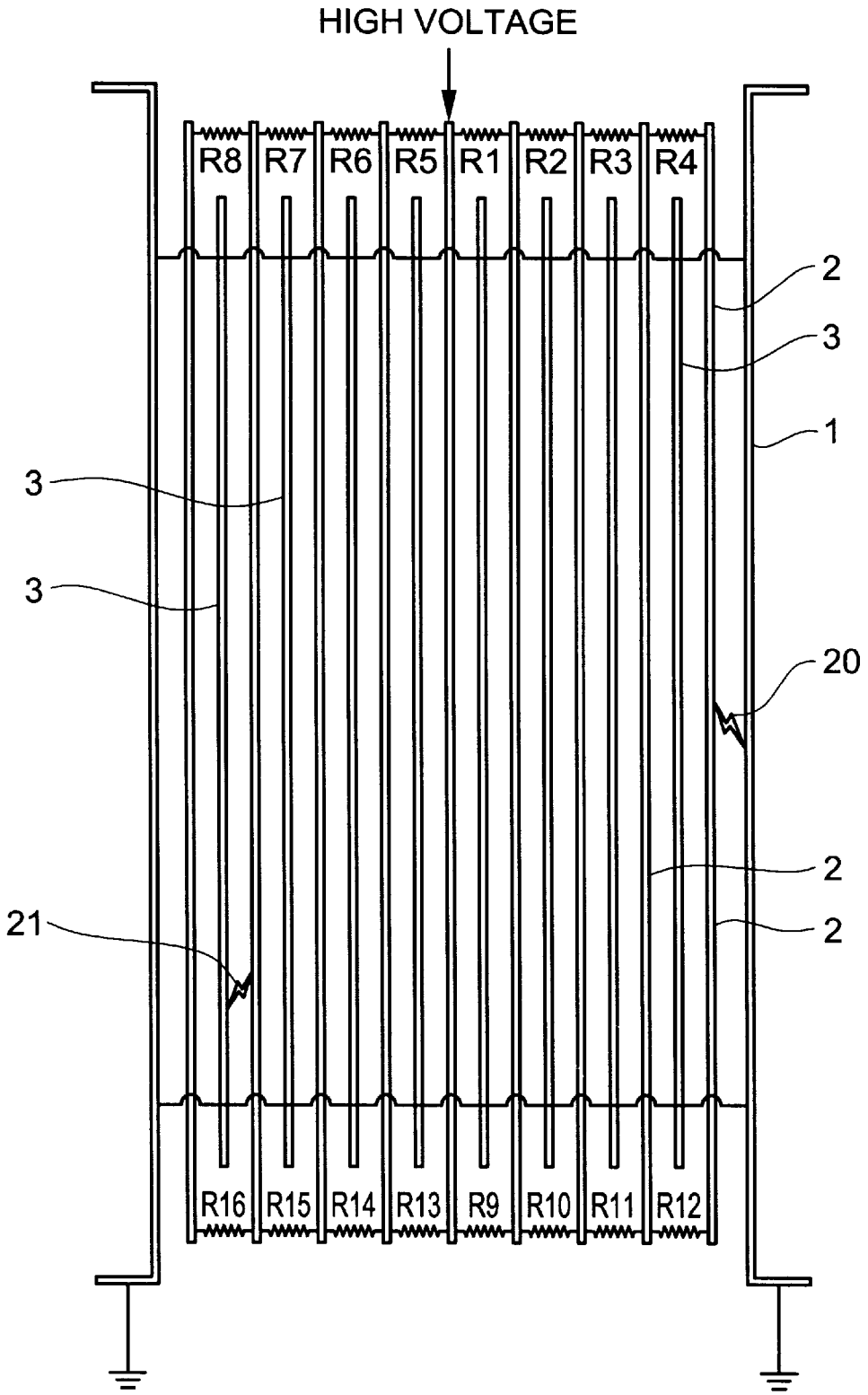
FIG. 2 is an electrical schematic representation of the precipitator shown in FIG. 1.

In FIG. 2, the two series of resistors R1–R8 and R9–R16 represent the two rows of ferrite spacers 14 along the two high voltage tie rods 5 shown in FIG. 1. The electrical schematic diagram of FIG. 2 represents the conductive aluminum spacers 10 of FIG. 1 as connecting together the grounded plates 3 of FIG. 1 without any resistance. In the event of a high voltage discharge or arc discharge at location 20 between an outermost charged plate 2 and the nearest grounded endplate 1 of the precipitator 100, high voltage from the power supply now has two routes to reach the discharge location 20 from the contact 11. The voltage has to go through the ferrite spacers 14 represented by R1, R2, R3 and R4 or through the ferrite spacers 14 represented by R9, R10, R11, and R12 to reach the discharge location 20. Both routes have comparable impedance that is sufficient to significantly reduce the arc noise.

If an arc discharge occurs at the location 21 shown in FIG. 2, high voltage from the power supply must go through the ferrite spacers 14 represented by R5, R6 and R7, or through the ferrite spacers 14 represented by R13, R14, and R15 to be discharged at the location 21. Furthermore, energy stored on other charged plates 2, for example by a capacitance of the charged plates 2, must also go through a series of ferrite spacers 14 to reach a discharge location such as the locations 20 and 21. Thus, impedances of the ferrite spacers 14 restrict or reduce the energy discharged in an arc discharge, and thereby greatly reduced associated arc noise. In the particular arrangement shown in FIGS. 1 and 2, the arc noise suppression will vary depending on the location of an arc discharge in the precipitator 100. This is because some arc discharge locations, for example the locations 20 and 21 described above, are separated from the contact 11 by a different number of intervening ferrite spacers 14 than other arc discharge locations.

Figure 3:
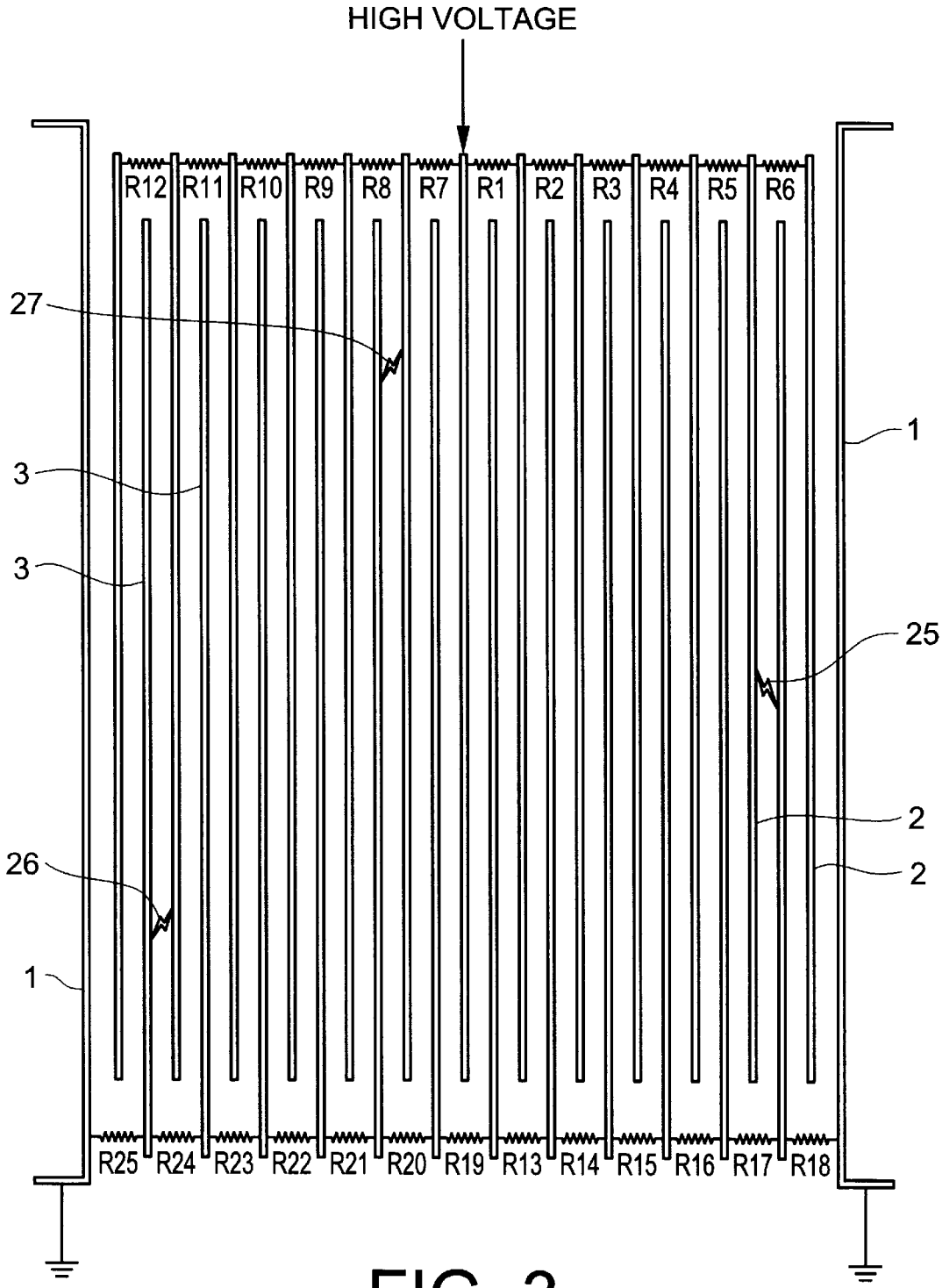
FIG. 3 is an electrical schematic representation of a precipitator using ferrite spacers to electrically contact charged plates and grounded plates, in accordance with an embodiment of the invention.

FIG. 3 is an electrical schematic diagram in accordance with another embodiment of the invention. This embodiment is similar to that shown in FIGS. 1 and 2, but differs in that additional ferrite spacers 14 are used instead of the aluminum spacers 10 shown in FIG. 1. Thus, as shown in FIG. 3, indicated by the two resistor series R1–R12 and R13–R25, the ferrite spacers 14 represented by the resistors R1–R12 are provided at the high voltage tie rods 5, and additional ferrite spacers 14 represented by resistors R13–R25 are also provided at the grounded tie rods 8 so that the grounded plates 3 are electrically separated from each other in the same way that the charged plates 2 are separated from each other. Only the two endplates 1 and the supporting braces 15 fastened to the endplates 1 are directly connected to ground.

The configuration shown in FIG. 3 provides the advantage of a more uniform reduction of energy discharged in an arc discharge and corresponding arc noise for arc discharges that occur at different locations. The reduction is more uniform because, for an arc discharge occurring at any location in the precipitator, the minimum number of ferrite spacers 14 that the arc discharge current will have to go through to travel from the connection point 11 to ground is the same. For example, an arc discharge at location 25 has to go through the six ferrite spacers 14 represented by R1, R2, R3, R4, R5, and R18 to dissipate to ground, while an arc discharge at location 26 also has to go through a total of six ferrite spacers 14 represented by R7, R8, R9, R10 R11, and R25. The same applies to an arc discharge at location 27, because its least resistance dissipation path is also through six ferrite spacers 14 represented by R7, R21, R22, R23, R24, and R25.

Figure 4:
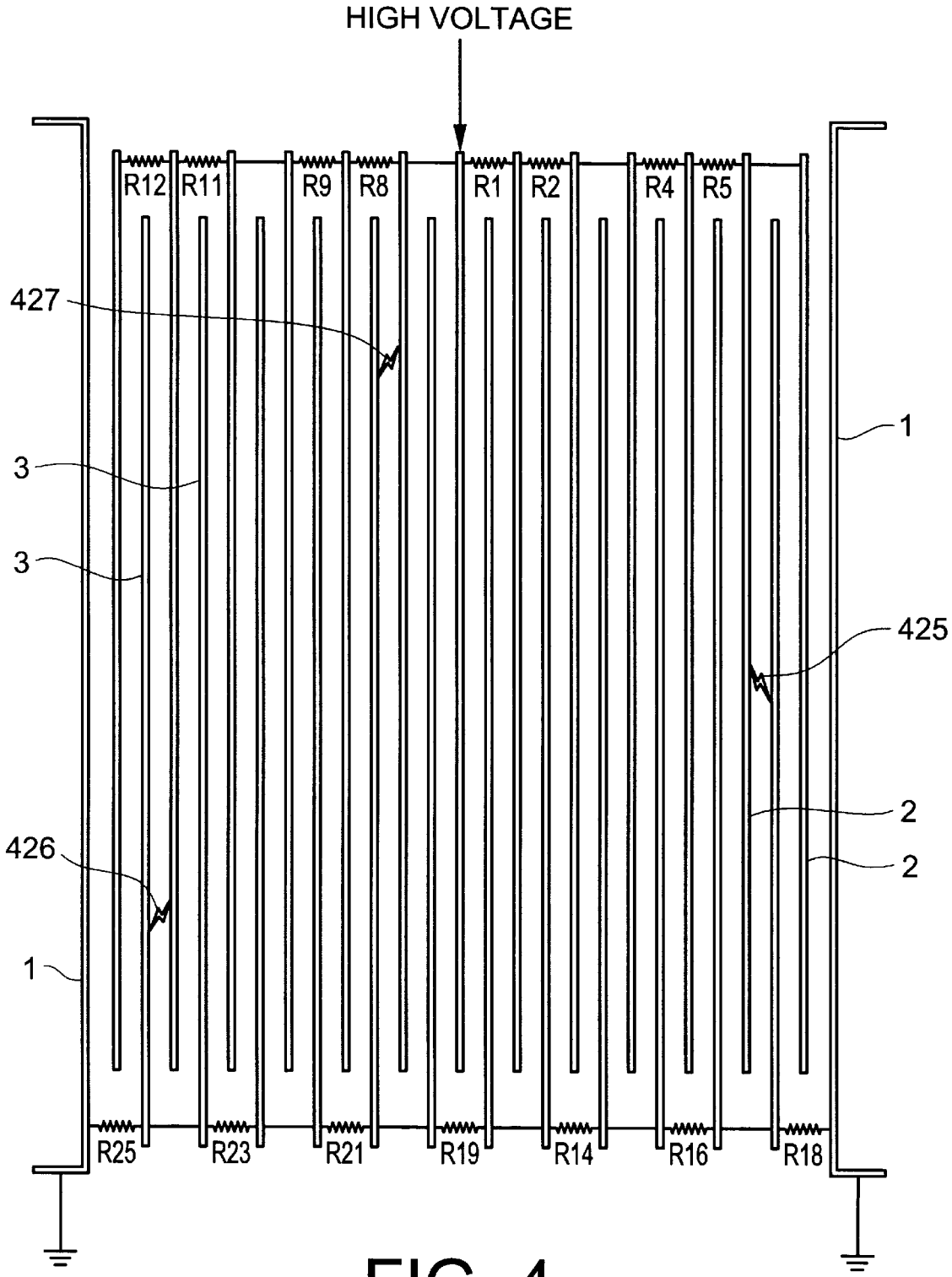
FIG. 4 is an electrical schematic representation of a precipitator using a combination of ferrite and aluminum spacers to electrically contact charged plates and grounded plates, in accordance with an embodiment of the invention.

FIG. 4 shows an electrical schematic diagram in accordance with another embodiment of the invention. This embodiment includes both ferrite spacers and aluminum spacers, and the aluminum spacers are used to adjust serial impedances in the precipitator. A power supply for the precipitator is equipped with anti-arc circuitry. The serial impedances are adjusted so that they are large enough to suppress arc noise to a satisfactory level, yet small enough to maintain the arc discharge's electrical noise signal at a minimum level that can be reliably detected by the power supply's anti-arc circuitry. Thus, the anti-arc circuitry can cause the power supply to stop supplying power when arcing is detected, as described further above.

The embodiment represented in FIG. 4 is similar to the embodiment shown in FIG. 1, but differs in the placement of ferrite spacers 14 and aluminum spacers 10 between the charged plates 2 and the grounded plates 3. In particular, the resistors R1–R12 shown in FIG. 4 represent ferrite spacers 14 positioned between charged plates 2, and the resistors R14–R25 represent ferrite spacers 14 positioned between grounded plates 3. As shown in FIG. 4, every third spacer between the charged plates 2 is an aluminum spacer 10, as represented by an absence of resistors, and the remaining spacers between the charged plates 2 are ferrite spacers 14, as represented by the resistors R1–R12. Every other spacer between the grounded plates 3 is an aluminum spacer, as represented by an absence of resistors, and the remaining spacers between the grounded plates 3 are ferrite spacers 14 as represented by the resistors R14–R25. In this configuration, the reduction of energy discharged in an arc discharge and the corresponding reduction in arc noise will vary somewhat depending on the location of the arc discharge. This is because the number of ferrite spacers 14 through which the discharge current must pass on its way from the connector 11 to ground varies depending on the location of the arc discharge. For example, an arc discharge occurring at location 427 will travel through three ferrite spacers 14, represented by the resistors R21, R23 and R25. In contrast, an arc discharge occurring at location 425 will travel through five ferrite spacers 14, represented by the resistors R1, R2, R4, R5 and R18. An arc discharge occurring at location 426 will travel through four ferrite spacers 14, represented by the resistors R8, R9, R11 and R25.

Figure 5:
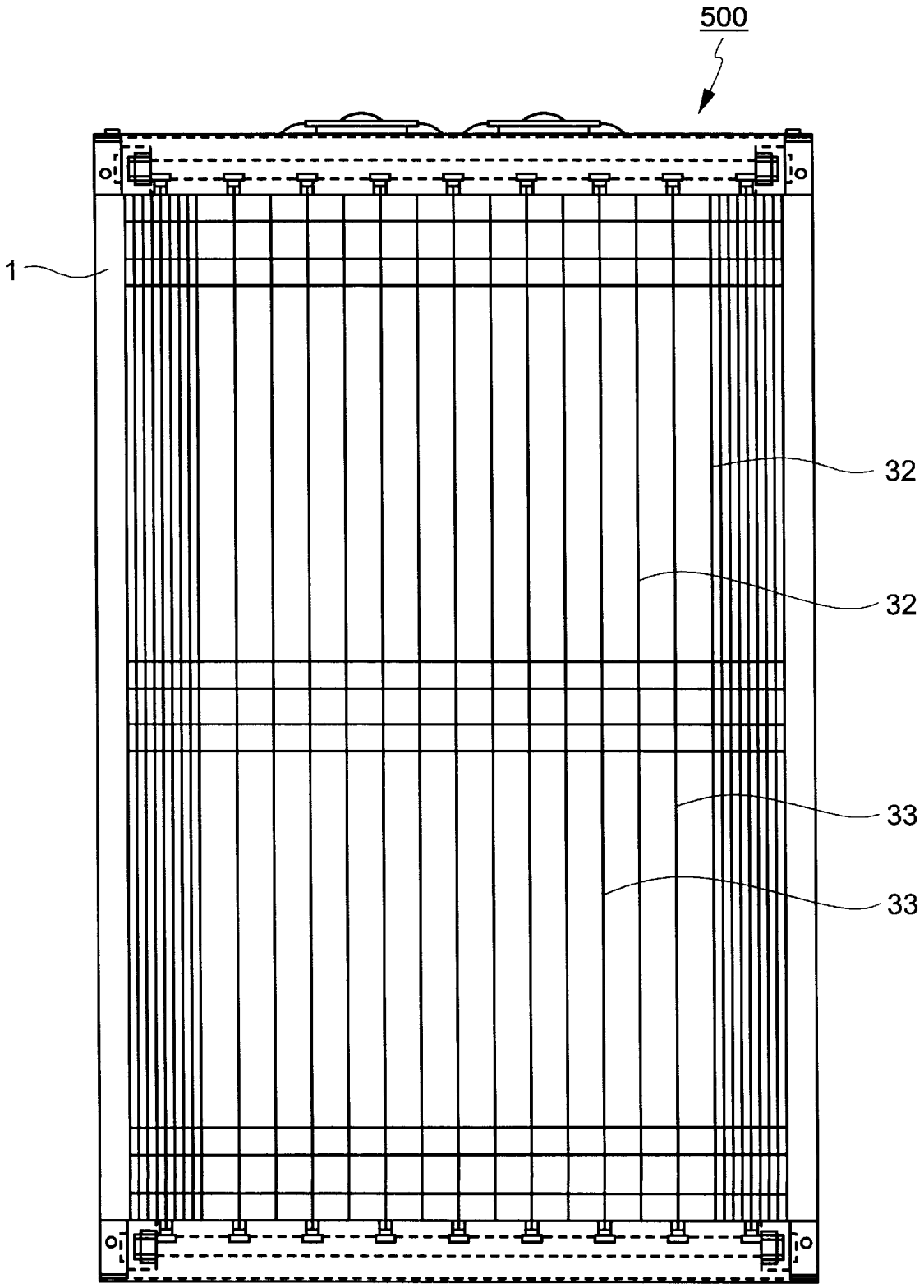
FIG. 5 is a front view of a two-stage electrostatic precipitator using ferrite spacers to control arc noise, where parallel precipitating plates are partially shown.
Figure 6:
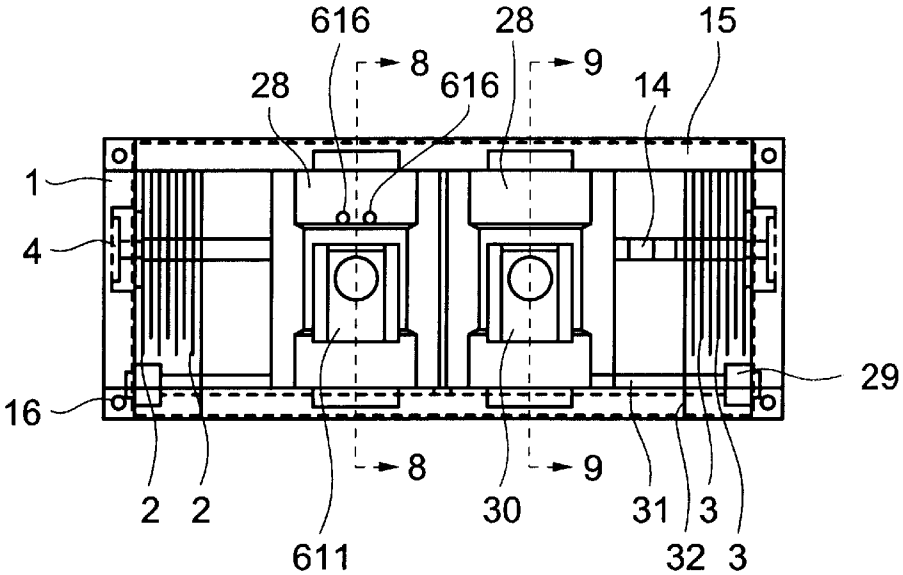
FIG. 6 is a top view of the electrostatic precipitator shown in FIG. 5, where the parallel precipitating plates are partially shown.

FIG. 5 is a front view of a two-stage electrostatic precipitator (ESP) unit 500 incorporating an embodiment of the invention. As shown in FIG. 5, ionizing wires 33 and extended ground plates 32 are provided. In FIGS. 5 and 6, only some of the precipitating plates 2, 3 are shown, so as not to obstruct or confuse the illustration of other features such as the ionizing wires 33.

FIG. 6 is a top view of the ESP unit 500. As shown in FIG. 6, an extended ground plate 32 is provided for every three regular grounded plates 3. The ionizing wire 33 is located between two adjacent extended grounded plates 32. The ionizing wire 33 generates corona current toward the extended grounded plates 32, thus forming high concentration ion curtains. A plastic contact guard 28 is also provided. Airborne particles must go through these high concentration ion curtains before entering the precipitating plates section, and are charged as they pass through the ion curtains. In this embodiment, ionization and precipitation are performed using different voltages. Accordingly, an ionizer voltage contact 30 is provided to furnish the ionizing wires 33 with a first voltage, and the voltage contact 611 furnishes a second voltage to the charged plates 2.

Figure 7:
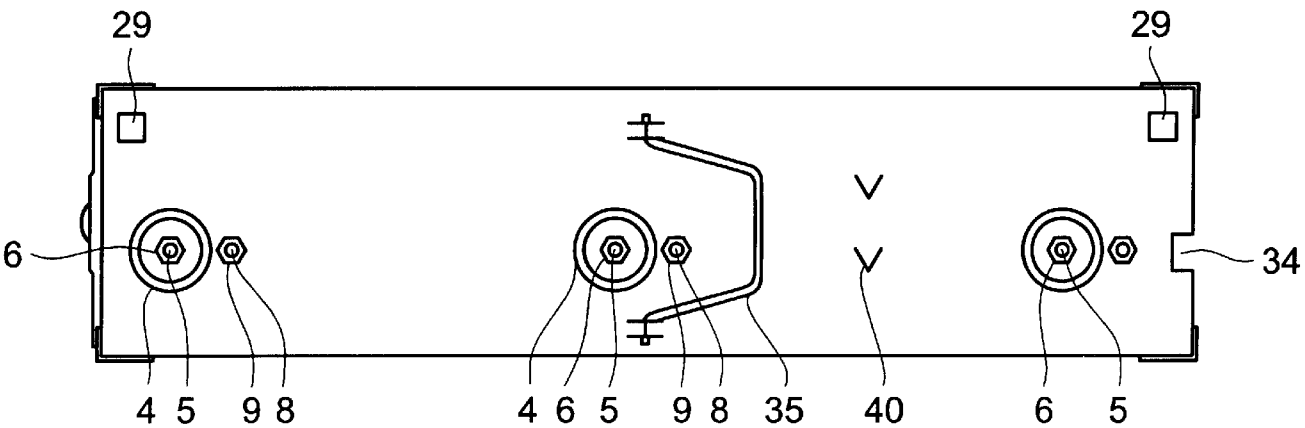
FIG. 7 is a side view of the electrostatic precipitator shown in FIG. 5.

FIG. 7 is a side view of the ESP unit 500. As shown in FIG. 7, the insulators 4 electrically isolate the high voltage tie rods 5 and nuts 6 from the grounded endplate 1. Three high voltage tie rods 5 and three grounded tie rods 8 are used. Handles 35 are provided on each endplate 1 for ease of handling of the precipitator. Since air flow must go through an ionization section first, a marking 40 to indicate air flow direction and a key way 34 are provided to ensure that the ESP unit 500 will be correctly inserted into a cabinet or operating housing.

Figure 8:
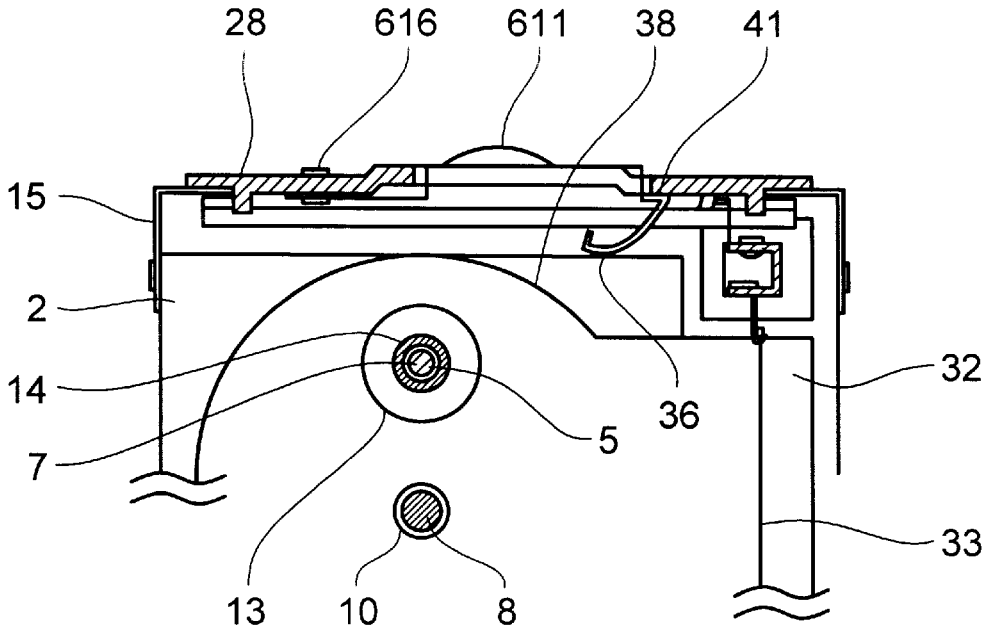
FIG. 8 is a sectional view along the line 8—8 of FIG. 6, showing high voltage contact with the charged plates.

FIG. 8 is a cross-sectional view along the line 8—8 of FIG. 6. The plastic contact guard 28 is secured by the front and back braces 15. The voltage contact 611 for the charged plates 2 is riveted to the contact guard 28 using rivets 616. The voltage contact 611 is one inch in width, and is formed such that it makes a solid electrical contact at location 36 on a top edge of one or two of the charged plates 2 in a middle section of the precipitator. When the voltage contact 611 is being pressed toward the charged plate 2 as for example by a contact mechanism from the power supply (not shown), the contact location 36 between the voltage contact 611 and the top of the charged plate 2 will slide laterally along the top of the charged plate 2 as it deflects, and a spring force in the voltage contact 611 will be generated. As shown in FIG. 8, a lip 41 of the contact guard 28 prevents the voltage contact 611 from moving away from the top of the charged plate 2, so that a solid, spring loaded contact between the voltage contact 611 and the top of the charged plate 2 is achieved at the contact location 36.

FIG. 8 also shows a ferrite spacer 14, and a metal tie rod 5 insulated by an insulator 7. The hole 13 allows the ferrite spacer 14 and the metal tie rod 5 to pass through the extended ground plate 32 with sufficient clearance so that an arc discharge will not occur between the ferrite spacer 14 and the extended ground plate 32. Upper edges of all of the grounded plates 2 and the extended ground plates 32 are provided with a radius 38, to provide sufficient clearance from the edges of the charged plates 2.

Figure 9:
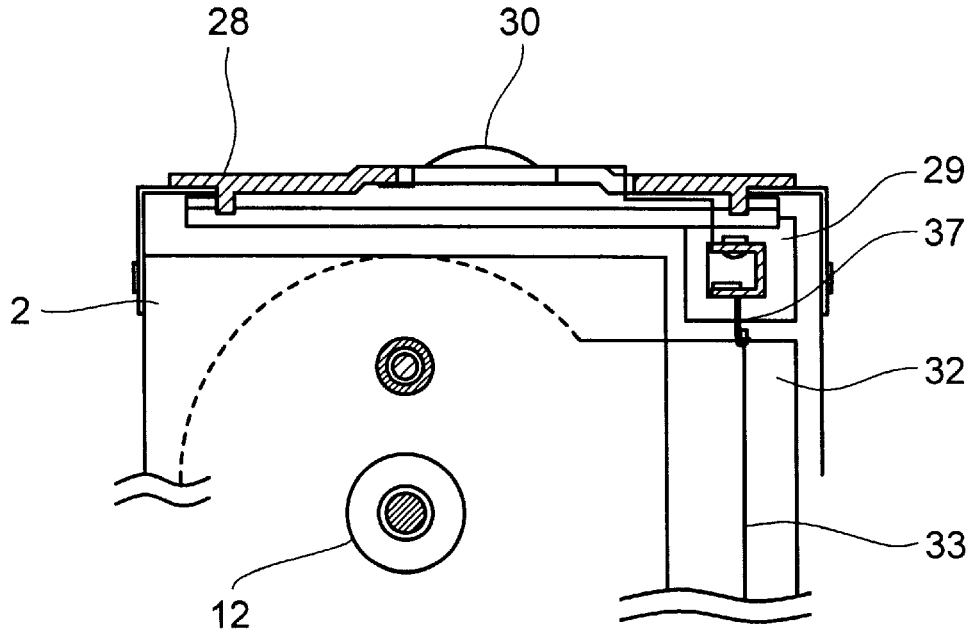
FIG. 9 is a sectional view along the line 9—9 of FIG. 6, showing high voltage contact with the ionizing wires.

FIG. 9 is a cross-sectional view along 9—9 line of FIG. 6, and particularly shows the high voltage contact 30 for the ionizing wires 33. FIG. 9 shows an ionizing wire support 37 made of 0.024 thick stainless steel, punched and formed such that each ionizing wire is hooked from a top to a bottom ionizing wire support 37 as shown in FIGS. 5, 8 9 and 10.

Figures 10A, 10B:
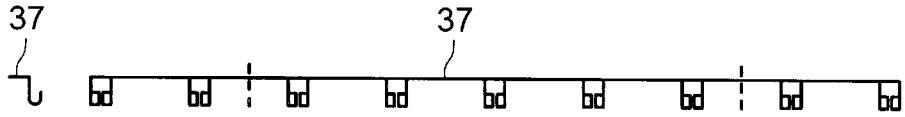
FIGS. 10A and 10B show front and side views of an ionizing wire support element.
Figures 11A, 11B:
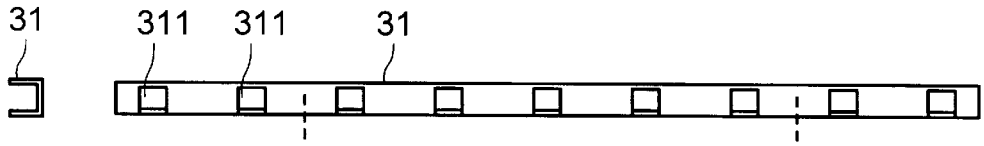
FIGS. 11A and 11B show front and side views of a metal brace used to house the ionizing wire support shown in FIGS. 10A and 10B.
Figures 12A, 12B:
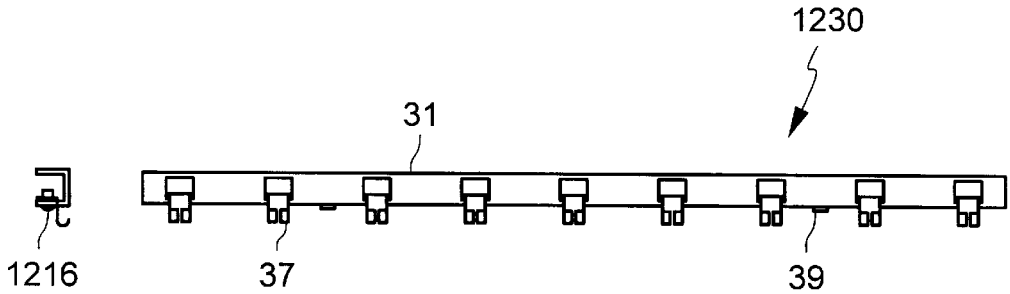
FIGS. 12A and 12B show front and side views of the ionizing wire support element of FIGS. 10A and 10B and the metal brace shown in FIGS. 11A and 11B, assembled together.

FIG. 10A shows a front view of the ionizing wire support 37, and FIG. 10B shows a side view of the ionizing wire support 37. The ionizing wire support 37 is fastened to a U-shaped metal brace 31 as shown in FIGS. 11A and 11B by rivets 1216. Windows 311 are made on the U-shaped brace 31 to allow the hooks of the ionizing wire support 37 to pass through the U-shaped brace 31. FIGS. 12A and 12B show the bottom ionizing wire support 37 riveted to the U-shaped metal brace 31.

Figures 13A, 13B:
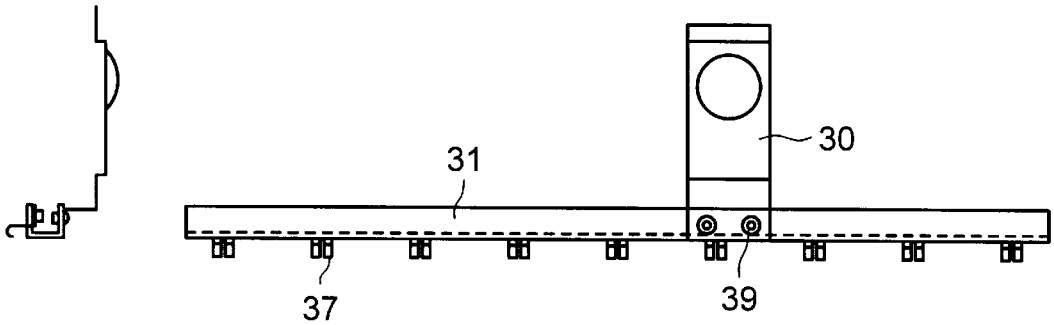
FIGS. 13A and 13B show front and side views of a high voltage contact secured to the ionizing wire support assembly of FIG. 12.

FIGS. 13A and 13B show an ionizer contact 30 riveted to the assembly shown in FIG. 12 with rivets 39. Insulators 29 are used to secure the assembly to the endplates 1 as shown in FIGS. 6, 7 and 9. The insulators 29 have square recesses to hold the U-shaped braces 31 in position, and can be made, for example, of plastic. The insulators 29 in turn are held in square holes on the endplates 1, as shown in FIGS. 6 and 7. The high voltage contact 30 for the ionizing wires 33 is shaped to have two right angle steps in order to provide sufficient clearance from the high voltage charged plates 2, as shown in FIG. 9.

A two-stage ESP having the design shown in FIG. 5 was built for collection efficiency and arc noise tests. The charged plates were assembled using ferrite spacers shaped in the form of beads 0.290 inches in length, 0.25 inches in inside diameter and 0.38 inches in outside diameter. The grounded plates were assembled using aluminum spacers having the same shape and dimensions as the ferrite spacers. The ionizer was powered at 8.4 kV, and the collecting plates were powered at 4.4 kV.

A collection efficiency of 98% was measured for DOP aerosols 0.3 microns diameter, at an air flow rate of 350 cubic feet per minute (cfm), which is performance comparable to that of an ESP having a similar structure but using all aluminum spacers instead of ferrite spacers in the precipitator.

With respect to arc noise, a screwdriver was used to short-circuit a charged plate to an adjacent grounded plate at various locations and resulting arc noise levels were measured 1 meter from the precipitator. Arc noise measurements ranged from 49 dB to 57 dB. The same test was then performed on an conventional precipitator of similar structure, having only aluminum spacers but no ferrite spacers (and therefore no arc noise suppression). Arc noise measurements for the conventional precipitator were more than 90 dB for all arc discharge locations. As these tests indicate, using ferrite spacers in accordance with the invention as described above dramatically reduced arc noise levels.

Although the precipitating plates have been described above as electrically connected to either ground (zero volts) and a large positive voltage, embodiments of the invention can include configurations where a first plurality of the precipitating plates are connected to a first electric potential, and a second plurality of the precipitating plates are connected to a second electrical potential. Various voltage combinations are possible. For example, one of the first and second electric potentials can be a positive voltage while the other of the potentials is either a zero voltage or a negative voltage. One of the first and second electric potentials can be a zero voltage, while the other of the potentials can be a negative voltage. The first and second electric potentials can also be both positive, or both negative. As those skilled in the art will appreciate, the first and second electric potentials can be variously selected to provide a difference between the first and second electric potentials that is sufficient to ensure effective collection of charged particles from air passing through the electrostatic precipitator.

The principles, preferred embodiments and modes of operation of the present invention have been described in the foregoing specification. However, the invention which is intended to be protected is not to be construed as limited to the particular embodiments disclosed. Further, the embodiments described herein are to be regarded as illustrative rather than restrictive. The invention could be used with devices other than electric air filters to control arcing, for example with any device that generates undesired arcs that can be interrupted or controlled if detected. Variations and changes may be made by others, and equivalents employed, without departing from the spirit of the present invention. Accordingly, it is expressly intended that all such variations, changes and equivalents which fall within the spirit and scope of the present invention as defined in the claims be embraced thereby.

What is claimed is:

1. A two-stage electrostatic precipitator, comprising:

a first plurality of plates at a first electric potential;

a second plurality of plates at a second electric potential; and a first plurality of ferrite spacers electrically connecting and physically separating the first plurality of plates from each other;

wherein when an arc discharge occurs between one of the first plurality of plates and an element having an electric potential different from the first electric potential, electrical current of the arc discharge passes through at least one of the ferrite spacers.

2. The precipitator of claim 1, wherein the electrical current of the arc discharge passes through the same number of ferrite spacers regardless from which of the first plurality of plates the arc discharge occurs.

3. The precipitator of claim 1, wherein an impedance of the at least one ferrite spacer suppresses an arc discharge noise.

4. The precipitator of claim 3, wherein the impedance includes an inductance.

5. The precipitator of claim 1, wherein the element is one of the second plurality of plates.

6. The precipitator of claim 1, wherein the first electric potential is a high voltage.

7. The precipitator of claim 1, wherein the first electric potential is zero volts.

8. The precipitator of claim 1, wherein one of the first and second electrical potentials is a positive voltage, and the other of the first and second electrical potentials is a negative voltage.

9. The precipitator of claim 1, further comprising a second plurality of ferrite spacers electrically connecting and physically separating the second plurality of plates from each other;

wherein when an arc discharge occurs from any one of the first and second plurality of plates, electrical current of the arc discharge passes through at least one of the ferrite spacers of the second plurality.

10. The precipitator of claim 1, wherein the first electric potential is directly provided to a middle one of the first plurality of plates.

11. The precipitator of claim 1, wherein the second electric potential is directly provided to a middle one of the second plurality of plates.

12. The precipitator of claim 1, further comprising ionizing wires and ionizing wire support means for supporting the ionizing wires.

13. The precipitator of claim 12, wherein a third electric potential is provided to the ionizing wires.

14. The precipitator of claim 12, wherein the ionizing wire support means comprises a first member having a plurality of hangers with slots for receiving ionizing wires, a U-shaped member having apertures for the hangers of the first member, and an electrical contact member; wherein the hangers protrude through the apertures of the U-shaped member, the U-shaped member supports the hangers against tension in the ionizing wires, and the U-shaped member is fastened to the electrical contact member.

15. A two-stage electrostatic precipitator, comprising:

a plurality of charged plates;

a plurality of grounded plates;

a plurality of ferrite spacers; and a plurality of low impedance spacers;

wherein;

each low impedance spacer has an impedance that is less than each ferrite spacer;

at least some of the ferrite spacers and at least some of the low impedance spacers electrically connect and physically separate at least one of a) at least two of the charged plates and b) at least two of the grounded plates;

when an arc discharge occurs from one of the charged plates, electrical current of the arc discharge passes through at least one of the ferrite spacers separating the plates.

16. The precipitator of claim 15, further comprising a power supply having arc detection circuitry, wherein a minimum arc discharge current of an arc discharge from one of the charged plates of the precipitator is a minimum amount necessary for the arc detection circuitry to reliably detect the arc discharge.

17. The precipitator of claim 15, wherein a supply voltage is directly applied to a middle one of the charged plates.

18. The precipitator of claim 15, wherein each ferrite spacer has an inductance.

19. The precipitator of claim 15, wherein the low impedance spacers are made of aluminum.

20. The precipitator of claim 15, wherein each ferrite spacer has an impedance including a resistance between about 200 Ohms and about 4,000,000 Ohms, and an inductance between about $1\times10^{-6}$ Henries and about $1\times10^{-3}$ Henries.

21. The precipitator of claim 20, wherein each ferrite spacer has an impedance including a resistance of about one million Ohms.

* * * * *